US011441269B2

(12) United States Patent
Collins et al.

(10) Patent No.: US 11,441,269 B2
(45) Date of Patent: Sep. 13, 2022

(54) WOVEN PAPERMAKING FABRIC HAVING CONVERGING, DIVERGING OR MERGING TOPOGRAPHY

(71) Applicant: Kimberly-Clark Worldwide, Inc., Neenah, WI (US)

(72) Inventors: Lynda Ellen Collins, Neenah, WI (US); Mark Alan Burazin, Oshkosh, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 158 days.

(21) Appl. No.: 16/650,065

(22) PCT Filed: Sep. 27, 2018

(86) PCT No.: PCT/US2018/053069
§ 371 (c)(1),
(2) Date: Mar. 24, 2020

(87) PCT Pub. No.: WO2019/067685
PCT Pub. Date: Apr. 4, 2019

(65) Prior Publication Data

US 2020/0240081 A1 Jul. 30, 2020

Related U.S. Application Data

(60) Provisional application No. 62/565,609, filed on Sep. 29, 2017.

(51) Int. Cl.
*D21F 1/00* (2006.01)
*D21F 7/08* (2006.01)
(Continued)

(52) U.S. Cl.
CPC ..... *D21F 11/006* (2013.01); *D21F 1/0036* (2013.01); *D21F 7/08* (2013.01);
(Continued)

(58) Field of Classification Search
CPC ..... D21F 11/006; D21F 1/0036; D21F 7/08; D21F 11/14; D21F 1/0027; D21F 5/18;
(Continued)

(56) References Cited

U.S. PATENT DOCUMENTS 5,228,482 A 7/1993 Fleischer
5,240,763 A 8/1993 Wagner et al.
(Continued)

FOREIGN PATENT DOCUMENTS

CN 2885922 Y 4/2007
CN 204000435 U 12/2014
(Continued)

OTHER PUBLICATIONS

Co-pending U.S. Appl. No. 16/650,050, filed Mar. 24, 2020, by Collins et al. for "Twill Woven Papermaking Fabrics.".
(Continued)

*Primary Examiner* — Eric Hug
(74) *Attorney, Agent, or Firm* — Kimberly-Clark Worldwide, Inc.

(57) ABSTRACT

Provided are woven papermaking fabrics having a web contacting surface having protuberances formed from woven warp and shute filaments. The protuberances, which may be oriented in the machine direction (MD) converge, merge or diverge and may be arranged to form a pattern. In certain instances the protuberance may comprise a first MD oriented protuberance having an element angle from about 0.5 to about 15 degrees, a second MD oriented protuberance having an element angle from about −0.5 to about −15 degrees wherein the first and second protuberances converge at a convergence area to form a third MD oriented protuberance having an element angle from about −15 to about 15 degrees.

12 Claims, 9 Drawing Sheets

(51) Int. Cl.

| | |
|---|---|
| ***D21F 11/00*** | (2006.01) |
| *D21F 11/14* | (2006.01) |
| *D21H 27/00* | (2006.01) |
| *D21H 27/02* | (2006.01) |

(52) U.S. Cl.
CPC ..... *D21F 11/14* (2013.01); *D21H 27/002* (2013.01); *D21H 27/02* (2013.01)

(58) Field of Classification Search
CPC . D21F 1/00; D21F 5/02; D21F 11/145; D03D 1/00; D03D 3/04; D03D 11/00; D03D 13/002; D03D 13/004; D03D 25/00; D21H 27/002; D21H 27/02; D21H 27/005
USPC ..... 162/116, 296, 348, 900, 902, 903; 139/383 A, 425 A
See application file for complete search history.

(56) References Cited

U.S. PATENT DOCUMENTS

| | | | | |
|---|---|---|---|---|
| 5,456,293 | A | 10/1995 | Ostermayer et al. | |
| 5,520,225 | A | 5/1996 | Quigley et al. | |
| 5,713,397 | A * | 2/1998 | Quigley ..... | D21F 11/006 139/383 A |
| 5,832,962 | A | 11/1998 | Kaufman et al. | |
| 6,402,895 | B1 | 6/2002 | Best | |
| 6,660,362 | B1 | 12/2003 | Lin et al. | |
| 6,673,202 | B2 | 1/2004 | Burazin et al. | |
| 7,166,189 | B2 | 1/2007 | Burazin et al. | |
| 7,235,156 | B2 | 6/2007 | Baggot | |
| 7,294,229 | B2 | 11/2007 | Hada et al. | |
| 7,300,543 | B2 | 11/2007 | Mullally et al. | |
| 7,611,605 | B2 | 11/2009 | Burazin et al. | |
| 7,611,607 | B2 * | 11/2009 | Mullally ..... | D21F 11/006 162/902 |
| 7,726,349 | B2 | 6/2010 | Mullally et al. | |
| 7,935,409 | B2 | 5/2011 | Burazin et al. | |
| 2001/0032712 | A1 | 10/2001 | Friedbauer et al. | |
| 2002/0056536 | A1 | 5/2002 | Lamb | |
| 2003/0079850 | A1 | 5/2003 | Rougvie | |
| 2003/0084952 | A1 | 5/2003 | Burazin et al. | |
| 2006/0278298 | A1 | 12/2006 | Ampulski et al. | |
| 2007/0209770 | A1 | 9/2007 | Barrett et al. | |
| 2008/0110591 | A1 | 5/2008 | Mullally et al. | |
| 2008/0169040 | A1 | 7/2008 | Barrett | |
| 2014/0231039 | A1 | 8/2014 | Patel et al. | |
| 2016/0215451 | A1 | 7/2016 | Uymur et al. | |
| 2017/0211235 | A1 | 7/2017 | Lamb | |

FOREIGN PATENT DOCUMENTS

| | | | |
|---|---|---|---|
| CN | 206438338 | U | 8/2017 |
| WO | 0012817 | A1 | 3/2000 |
| WO | 13023276 | A1 | 2/2013 |
| WO | 2015149992 | A1 | 10/2015 |
| WO | 20068091 | A1 | 4/2020 |
| WO | 20068092 | A1 | 4/2020 |

OTHER PUBLICATIONS

Co-Pending U.S. Appl. No. 16/650,058, filed Mar. 24, 2020, by Collins et al. for "Woven Papermaking Fabric Including Stablilized Weave Providing Textured Contacting Surface.".
Co-Pending U.S. Appl. No. 16/650,068, filed Mar. 24, 2020, by Collins et al. for "Woven Papermaking Fabric Having Machine and Cross-Machine Oriented Topography ".

* cited by examiner

WOVEN PAPERMAKING FABRIC HAVING CONVERGING, DIVERGING OR MERGING TOPOGRAPHY

BACKGROUND OF THE INVENTION

In the manufacturing of tissue products, particularly absorbent tissue products such as bath tissue and facial tissue products, there is a continuing need to improve the physical properties of the tissue and offer a differentiated product appearance. It is generally known that molding a partially dewatered cellulosic web on a topographical papermaking fabric will enhance the finished paper product's physical properties, such as sheet bulk, stretch and softness, and aesthetics. Such molding can be applied by fabrics in a through-air dried process, such as the process disclosed in U.S. Pat. No. 5,672,248, or in a wet-pressed tissue manufacturing process, such as that disclosed in U.S. Pat. No. 4,637,859.

Exemplary papermaking fabrics are disclosed in U.S. Pat. No. 6,998,024, which teaches woven papermaking fabrics with substantially continuous machine direction ridges whereby the ridges are made up of multiple warp filaments grouped together. The ridges are higher and wider than individual warps. The wide wale ridges have a ridge width of about 0.3 cm or greater and the frequency of occurrence of the ridges in the CD is from about 0.2 to 3 per centimeter. In the examples shown, the shute diameters are both larger than or smaller than the warp diameters but only one shute diameter is utilized.

Other woven papermaking fabrics are disclosed in U.S. Pat. No. 7,611,607, which teaches fabrics having substantially continuous, not discrete, machine-direction ridges separated by valleys, where the ridges are formed of multiple warp filaments grouped together and supported by multiple shute strands of two or more diameters. The ridges are generally oriented parallel to the machine direction axis of the fabric, however, in certain instances the ridges are oriented at an angle of about 5 degrees relative to the machine direction axis. In those instance where the ridges are angled relative to the machine direction axis, they may be woven so as to regularly reverse direction in terms of movement in the cross-machine direction, creating a wavy appearance which can enhance aesthetics of the resulting tissue product. While the ridges could be angled with respect to the machine direction axis, the degree of orientation is limited. Moreover, the ridges needed to be continuous and the angle of orientation could only change after traversing approximately one-half of the cross-machine spacing between the ridges.

Thus, the prior art woven papermaking fabrics have generally been limited to topographies oriented substantially in the machine direction, with some small degree of variability. Machine direction oriented topography present several problems primarily in fabric manufacturing and in limitations in aesthetic appearances that can be created. Machine direction oriented topography often relies upon warp yarns to form machine direction oriented ridges with fewer interchanges than warp yarns in the adjacent valleys causing differences in warp tension. The tension differences often result in the ridges of the fabric becoming slack and ceasing to weave. Once a warp yarn ceases to weave into the fabric, they become so slack that they are in danger of being broken by the projectile of the loom. Thus, there remains a need in the art for a new weave structure to address the limitations of current weave structures for woven paper machine clothing.

SUMMARY

It has now been discovered that woven papermaking fabrics having protuberances that converge, merge or diverge may be manufactured in an efficient and stable manner so as to produce woven fabrics useful in the manufacture of tissue products having visually appealing ascetics and desirable physical properties. The newly discovered weave patterns may be used to provide the web contacting surface of the papermaking fabric with protuberances that bend and can be arranged such that they converge, merge or diverge from one another. In this manner the weave patterns may be used to arrange protuberances to create geometric shapes and designs that may form a pattern. At the same time protuberances may be woven so to provide papermaking fabrics having a high degree of topography, which may be useful in the manufacture of tissue products.

Creating woven structures having both high topography and protuberances that can be bent to form converging, diverging and merging patterns, requires careful balancing of forces within the woven structure. Unbalanced forces within the woven structure results in undesirable lateral crimping of shute filaments or the crossing of individual shute filaments, as well as diminished z-direction protuberance height. Accordingly, in one embodiment the present weave patterns may be used to produce papermaking fabrics having a plurality of machine direction (MD) oriented protuberances that form the upper most web contacting surface of the fabric, wherein the plurality of MD oriented protuberances may be initiated and terminated, and arranged so as to converge, merge, or diverge with/from one another.

In other embodiments the present invention provides a weave pattern that carefully balances the forces within the woven structure, the weave pattern resulting in a woven papermaking fabric comprising shute filaments interwoven with weft elements interwoven with one another to form a web contacting surface comprising a plurality of machine direction (MD) oriented protuberances having a length, width and height, wherein a first MD oriented protuberance has a first principal axis oriented in a first direction and an element angle from about 0.5 to about 15 degrees and a second MD oriented protuberance has a second principal axis oriented in a second direction and an element angle from about −0.5 to about −15 degrees and the first and second MD oriented protuberances converge at a convergence area to form a third MD oriented protuberance having a third principal axis oriented in a third direction and an element angle from about −15 to about 15 degrees.

In another embodiment the present invention provides a woven papermaking fabric having a machine contacting surface and a web contacting surface wherein the web contacting surface comprises a three-dimensional topography consisting of a first machine direction (MD) oriented protuberance having a first principal axis oriented in a first direction and an element angle from about 0.5 to about 15 degrees, the first protuberance comprising a plurality of warp filaments that are staggered by two or more shute filaments, but overlap to some degree, and a second MD oriented protuberance having a second principal axis oriented in a second direction and an element angle from about 0.5 to about 15 degrees, the second protuberance comprising a plurality of warp filaments that are staggered by two or more shute filaments, wherein the first and second protuberances converge at a convergence area. The warp filaments can vary in length, but typically rise above from about five to about forty, such as from about ten to about thirty shute filaments, depending on the size and spacing of the shute filaments. The extent to which adjacent warp filaments forming a given protuberance overlap each other may vary, such as from two to ten shute filaments and more preferably from about three to eight shute filaments, allowing the end of one warp float to tuck under the next machine direction oriented warp float. In this manner the weave pattern yields protuberances comprising warp stacks with a degree of symmetry where warps are introduced and ended in uniform spacing.

In still other embodiments the present invention provides a weave pattern comprising two or more machine direction oriented warp filaments, such as from two to eight warp filaments or four to six warp filaments, woven to form a protuberance on the web contacting surface where the distal end of a first warp float and the proximal end of an adjacent warp float overlap one another a distance of two to ten shute filaments and more preferably from about three to eight shute filaments to form a first machine direction (MD) oriented protuberance having a first principal axis oriented in a first direction and an element angle from about 0.5 to about 15 degrees, the first MD oriented protuberance converging with a second MD oriented protuberance at a convergence area. In a particularly preferred embodiment the convergence area comprises at least four directly adjacent warp filaments woven above their corresponding shute filaments, wherein at least two of the directly adjacent warp filaments form a portion of the first and second protuberances and each of the directly adjacent warp filaments rise above at least four shute filaments.

In certain embodiments the convergence area may also comprise banding, which may comprise a stitch disposed at the first and second lateral ends of the warps forming the convergence area. In a particularly preferred embodiment bands comprise a first directly adjacent (in the cross-machine direction) stitch in which the interchange of warp and shute filaments comprises a warp filament above the shute float and second directly adjacent stitch in which the interchange of warp and shute filaments comprises a warp filament below the shute float. The convergence area may comprise one, two or three pairs of bands.

In yet other embodiments the present invention provides a woven papermaking fabric comprising a plurality of warp filaments and a plurality of cross-machine direction (CD) oriented shute filaments, the shute filaments being interwoven with warp filaments to provide a textured web contacting side of the woven papermaking fabric and machine contacting side of the woven papermaking fabric, a first machine direction (MD) oriented protuberance having a first principal axis oriented in a first direction and an element angle from about 0.5 to about 15 degrees, the protuberance comprising a plurality warp filaments that are staggered by two or more shute filaments, but overlap to some degree, and a second MD oriented protuberance having a second principal axis oriented in a second direction and an element angle from about −0.5 to about −15 degrees, wherein the first and second protuberances define a valley there between having a valley depth greater than about 0.35 mm.

DEFINITIONS

Figure 1:
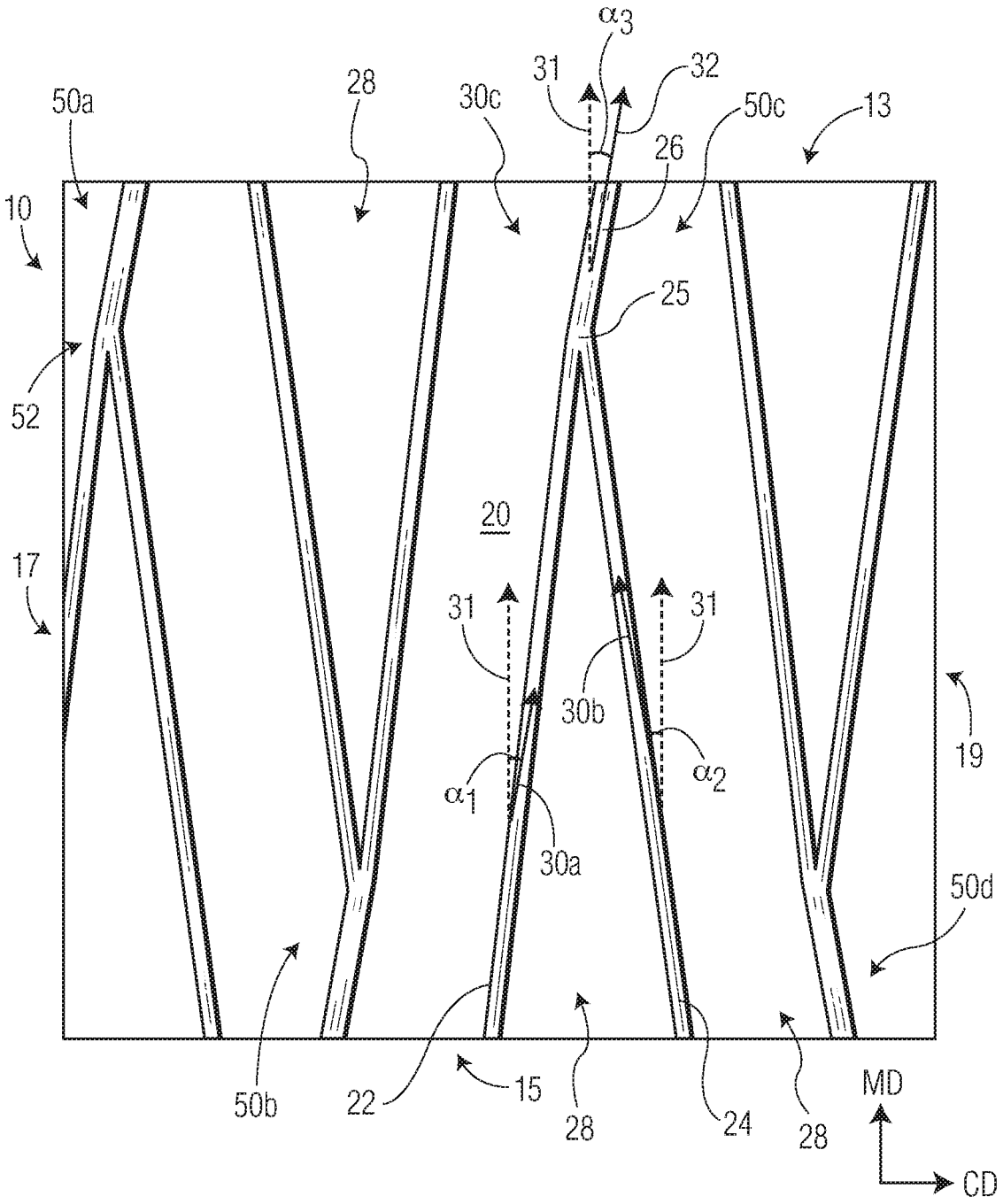
FIG. 1 is a top view of a woven papermaking fabric having a three-dimensional fabric contacting surface according to one embodiment of the present invention.

As used herein, the term "tissue product" refers to products made from tissue webs and includes, bath tissues, facial tissues, paper towels, industrial wipers, foodservice wipers, napkins, medical pads, medical gowns, and other similar products. Tissue products may comprise one, two, three or more plies.

As used herein, the terms "tissue web" and "tissue sheet" refer to a fibrous sheet material suitable for forming a tissue product.

As used herein, the term "papermaking fabric" means any woven fabric used for making a cellulose web such as a tissue sheet, either by a wet-laid process or an air-laid process. Specific papermaking fabrics within the scope of this invention include forming fabrics; transfer fabrics conveying a wet web from one papermaking step to another, such as described in U.S. Pat. No. 5,672,248; as a molding, shaping, or impression fabrics where the web is conformed to the structure through pressure assistance and conveyed to another process step, as described in U.S. Pat. No. 6,287,426; as creping fabrics as described in U.S. Pat. No. 8,394,236; as embossing fabrics as described in U.S. Pat. No. 4,849,054; as a structured fabric adjacent a wet web in a nip as described in U.S. Pat. No. 7,476,293; or as a through-air drying fabric as described in U.S. Pat. Nos. 5,429,686, 6,808,599 B2 and 6,039,838. The fabrics of the invention are also suitable for use as molding or air-laid forming fabrics used in the manufacture of non-woven, non-cellulosic webs such as baby wipes.

Fabric terminology used herein follows naming conventions familiar to those skilled in the art. For example, as used herein the term "warps" generally refers to machine-direction yarns and the term "shutes" generally refers to cross-machine direction yarns, although it is known that fabrics can be manufactured in one orientation and run on a paper machine in a different orientation.

As used herein, the term "directly adjacent" when referring to the relation of one filament to another means that no other filaments are disposed between the referenced filaments. For example, if two warp filaments forming a portion of a protuberance are said to be directly adjacent to one another, no other warp filaments are disposed between the two protuberance forming warp filaments.

As used herein the term "protuberance" refers to a three-dimensional element of a papermaking fabric in the shape of a line, which may be continuous, discrete, interrupted, and/or a partial line with respect to a fabric on which it is present. The protuberance may be of any suitable shape such as straight, bent, kinked, curled, curvilinear, serpentine, sinusoidal, and mixtures thereof. In one example, a protuberance may comprise a plurality of discrete elements formed by warp filaments woven above their corresponding shute filaments that are oriented together to form a visually continuous protuberance.

As used herein, the term "protuberance forming portion" refers to the woven warp or shute filaments that form a portion of the protuberance. In certain instances the protuberance forming portion may comprise a plurality of adjacent warp/shute filament interchanges that are woven such that the warp filaments are woven above their respective shute filaments. The protuberance forming portion may extend substantially in the machine direction and extend over at least five shute filaments in the machine direction, or at least seven shute filaments, or at least ten shute filaments.

As used herein, the term "valley" generally refers to a portion of the web contacting surface of the papermaking fabric lying between adjacent protuberances.

As used herein, the "valley bottom" is defined by the top of the lowest visible yarn which a tissue web can contact when molding into the textured fabric. The valley bottom can be defined by a warp knuckle, a shute knuckle, or by both. The "valley bottom plane" is the z-direction plane intersecting the top of the elements comprising the valley bottom.

As used herein, the term "valley depth" generally refers to z-directional depth of a given valley and is the difference between C2 (95 percentile height) and C1 (5 percentile height) values, having units of millimeters (mm), as measured by profilometry and described in the Test Method section below. In certain instances valley depth may be referred to as S90. To determine valley depth a profilometry scan of a fabric is generated as described herein, from which a histogram of the measured heights is generated, and an S90 value (95 percentile height (C2) minus the 5 percentile height (C1), expressed in units of mm) is calculated. Generally the instant fabrics have relatively deep valleys, such as valleys having valley depths greater than about 0.30 mm, more preferably greater than about 0.35 mm and still more preferably greater than about 0.40 mms, such as from about 0.30 to about 1.0 mm.

As used here, the term "valley width" generally refers to the width of a valley disposed on a fabric according to the present invention and is the Psm value, having units of millimeters (mm), as measured by profilometry and described in the Test Method section below. The valley width of a given fabric may vary depending on the weave pattern, however, in certain instances the valley width may be greater than about 1.0 mm, more preferably greater than about 1.5 mm and still more preferably greater than about 2.0 mm, such as from about 1.5 to about 3.5 mm.

As used herein, the term "element angle" generally refers to the orientation of the machine direction (MD) oriented protuberances relative to the MD axis of the fabric. Element angle is generally measured by profilometry and described in the Test Method section below. Preferably the fabrics of the present invention have a plurality of protuberances, wherein the protuberances have an element angle from about −15 to about 15 degrees. In certain instances a first protuberance may have an element angle from about 2.0 to about 10 degrees and a second protuberances, which converges with the first protuberance, may have an element angle from about −2.0 to about −10 degrees.

As used herein, the term "wall angle" generally refers to the angle formed between a given valley bottom and an adjacent machine direction (MD) oriented protuberance and is the Pdq value, having units of degrees (°), as measured by profilometry and described in the Test Method section below. Generally the instant fabrics have MD oriented protuberances with relatively steep wall angles, such as wall angles greater than about 20 degrees and more preferably greater than about 22 degrees and still more preferably greater than about 24 degrees, such as from about 20 to about 45 degrees and more preferably from about 22 to about 40 degrees.

As used herein the term "discrete" when referring to an element of a papermaking fabric according to the present invention, such as a valley, means that the element is visually unconnected from other elements and does not extend continuously in any dimension of the papermaking fabric surface.

As used herein, the term "discrete protuberance" refers to separate, unconnected three-dimensional elements disposed on a papermaking fabric that do not extend continuously in any dimension of the fabric. A protuberance may be discrete despite being formed from a single continuous filament. For example, a single continuous warp filament may be woven such that it forms a plurality of discrete machine direction oriented protuberances where each protuberance has a first proximal end and a first distal end where the ends of the protuberance terminate at spaced apart shute filaments.

As used herein the term "continuous" when referring to a three-dimensional element of a papermaking fabric according to the present invention, such as a protuberance or a pattern, means that the element extends throughout one dimension of the papermaking fabric surface. When referring to a protuberance the term refers to a protuberance comprising two or more warp filaments that extends without interruption throughout one dimension of the woven fabric.

As used herein, the term "uninterrupted" generally refers to a protuberance having an upper surface plane that extends without interruptions and remains above the valley surface plane for its duration. Undulations of the upper surface plane within a protuberance such as those resulting from twisting of warp filaments or warp filaments forming the protuberance tucking under one another are not considered to be interruptions.

As used herein the term "line element" refers to a three-dimensional element of a papermaking fabric, such as a protuberance, in the shape of a line, which may be continuous, discrete, interrupted, and/or a partial line with respect to a fabric on which it is present. The line element may be of any suitable shape such as straight, bent, kinked, curled, curvilinear, serpentine, sinusoidal, and mixtures thereof. In one example, a line element may comprise a plurality of discrete elements that are oriented together to form a visually continuous line element.

As used herein the term "pattern" refers to any non-random repeating design, figure, or motif. Generally the fabrics of the present invention may comprise decorative patterns comprising a plurality of protuberances, however, it is not necessary that the protuberances form recognizable shapes, and a repeating design of the protuberances is considered to constitute a decorative pattern.

As used herein the term "twill pattern" generally refers to a pattern of parallel protuberances having an element angle greater than about 0.5 degrees, such as from about 0.5 to about 15 degrees, and protuberances that extend uninterrupted along their entire distance.

DETAILED DESCRIPTION

The present inventors have now surprisingly discovered that certain woven papermaking fabrics, and in particular woven transfer and through-air drying (TAD) fabrics, having patterns disposed thereon may be used to produce tissue webs and products having high bulk and visually appealing aesthetics without compromising operating efficiency. Papermaking fabrics of the current invention are generally directed to woven fabrics but may be suitable as base fabrics upon which to add additional material to enhance tissue physical properties or aesthetics. For example, the instant woven fabrics may be used in the manufacture of a papermaking fabric having a foraminous woven base member surrounded by a hardened photosensitive resin framework. In other instances the instant woven fabrics may be used in the manufacture of a papermaking fabric having a foraminous woven base member with a polymeric material disposed thereon by printing, extruding or well-known additive manufacturing processes.

The present fabrics may be used in the manufacture of a broad range of fibrous structures, particularly wet-laid fibrous structures and more particularly, wet-laid tissue products such as bath tissues, facial tissues, paper towels, industrial wipers, foodservice wipers, napkins and other similar products. Further, the inventive fabrics are well suited for use in a wide variety of tissue manufacturing processes. For example, the fabrics may be used as TAD fabrics in either uncreped or creped applications to generate aesthetically acceptable patterns and good, bulky tissue product attributes. Alternatively, the fabrics may be used as impression fabrics in wet-pressed papermaking processes.

Accordingly, in one embodiment, the invention resides in a woven papermaking fabric having a machine direction (MD) axis and a cross-machine direction (CD) axis, a machine contacting surface and a sheet contacting surface where the sheet contacting surface is textured and comprises a plurality of protuberances oriented at an angle relative to the MD axis of the fabric. For example, the web contacting surface of the fabric may comprise a first protuberance having a first principal axis oriented in a first direction and an element angle from about 0.5 to about 15 degrees and a second protuberance having a second principal axis oriented in a second direction and an element angle from about −0.5 to about −15 degrees, wherein the first and second protuberances converge or merge at a convergence area to form a third protuberance having a third principal axis oriented in a third direction and an element angle from about −15 to about 15 degrees. In a particularly preferred embodiment the principle axis of the first, second and third protuberances, relative to the MD axis, are different and the protuberances have different element angles.

The protuberances are generally woven from two or more directly adjacent warp filaments supported by a shute strand. In other instances three or more machine direction oriented warp filaments may be combined to form a protuberance on the web contacting surface of the fabric. Accordingly, in certain embodiments a protuberance may comprise from two to eight, or three to six, warp filaments. The warp filaments forming the protuberance may extend substantially in the machine direction and extend over at least five shute filaments in the machine direction, or at least seven shute filaments, or at least ten shute filaments, such as from five to forty shute filaments. When referring to the number of shute filaments traversed by the warp filaments forming a given element the term "float length" will be used. For example, a warp filament forming the protuberance that extends substantially in the machine direction over five shute filaments is said to have a float length of five.

The warp filaments forming the protuberance are woven such that they are laterally offset from one another in the machine direction. In this manner the distal end of a first warp filament and the proximal end of a directly adjacent warp filament overlap to an extent to form a paired portion. The paired portion may have a float length from two to ten and more preferably from three to eight. Weaving the warp filaments in this paired, offset, manner allows the end of one warp float to tuck under the next machine direction oriented warp float. As a result the weave pattern yields protuberances comprising warp stacks with a degree of symmetry where warps are introduced and ended in uniform spacing.

The warp filaments may be woven to form protuberances that form a twill pattern that extends in a continuous manner across the fabric. The twill pattern is formed from parallel protuberances having a principal axis that while generally oriented in the machine direction (MD) are slightly skewed to provide an element angle from about ±0.5 to about ±15 degrees relative to the machine direction axis.

Between adjacent protuberances are valleys, which may be continuous or discrete. In certain instances the protuberances are woven in a pattern such that valleys disposed there between are entirely bounded by the protuberance and thus may be described as being discrete. The valleys may be oriented at an angle relative to the MD axis like the surrounding protuberances. In a particularly preferred embodiment the valleys are bound by protuberances woven in a twill pattern where the transition from the valley to the protuberance forms relatively steep sidewalls. Thus, in certain instances, the valley walls formed by adjacent protuberances may be relatively steep, such as wall angles greater than about 20 degrees and more preferably greater than about 22 degrees and still more preferably greater than about 24 degrees, such as from about 20 to about 45 degrees and more preferably from about 22 to about 40 degrees.

While in certain embodiments the protuberances are generally in the form of straight or substantially straight lines arranged in parallel with a single element angle, the invention is not so limited. In other embodiments the protuberances may have a curvilinear shape and a given protuberance may comprise segments having more than one axis of orientation and more than one element angle. Despite having segments with different element angles a given curvilinear protuberance generally has a major axis that is machine direction oriented.

The protuberances are further arranged such that a protuberance having a first principal axis extending in a first direction and forming a portion of a first twill pattern may be merged with, converge with or diverge from a second protuberance having a second principal axis extending in a second direction. In this manner the protuberances may be arranged in a pattern comprising two or more twill patterns where the protuberances forming the patterns have a principal axis extending in different directions and with different element angles. In a particularly preferred embodiment all of the protuberances are machine direction oriented within the plane of the papermaking fabric and have an element angle from about ±0.5 to about ±15 degrees. Of course, the directions of the protuberance alignments refer to the principal alignment of the protuberances. Within each alignment, the protuberance may have segments aligned at other directions, but aggregate to yield the particular alignment of the entire protuberance. Further, while the above description is in reference to protuberances that are continuous, in other embodiments one or more of the protuberances may be discrete.

If a papermaking fabric includes multiple protuberances, it is contemplated that a plurality of, or all of, the protuberances can be configured substantially the same in terms of any one or more of characteristics of height, width, or length. It is also contemplated that a papermaking fabric can be configured with protuberances configured such that one or more characteristics of height, width, or length of the protuberances vary from one protuberance to another protuberance. In certain embodiments substantially all the protuberances are substantially oriented in the machine direction and have substantially similar characteristics of height, width, or length.

With reference now to FIG. 1, one embodiment of a papermaking fabric according to the present invention is illustrated. The fabric 10 has two principal dimensions—a machine direction ("MD"), which is the direction within the plane of the fabric 10 parallel to the principal direction of travel of the tissue web during manufacture and a cross-machine direction ("CD"), which is generally orthogonal to the machine direction. The papermaking fabric 10 generally comprises a plurality of filaments that can be woven together. The papermaking fabric can include a first longitudinal end 13 and a second longitudinal end 15 that can be joined to form a seam. As will be described in further detail below, the filaments can include a plurality of warp filaments and a plurality of shute filaments that can be woven together to form a machine contacting side 18 and a web contacting side 20 of the woven papermaking fabric 10. The web contacting side 20 can be opposite from the machine contacting side. Machinery employed in a typical papermaking operation is well known in the art and may include, for example, vacuum pickup shoes, rollers, and drying cylinders. In a preferred embodiment, the papermaking fabric 10 comprises a through-air drying fabric useful for transporting an embryonic tissue web across drying cylinders during the tissue manufacturing process. However, in other embodiments, the woven papermaking fabric 10 can comprise a transfer fabric for transporting an embryonic tissue web from forming wires to a through-air drying fabric. In these embodiments, the web contacting side 20 supports the embryonic tissue web, while the opposite surface, the machine contacting side 18, contacts the surrounding machinery.

The web contacting side 20 of the fabric 10 comprises a plurality of protuberances 22, 24, 26. The protuberances 22, 24, 26 are generally disposed on the web-contacting surface 20 for cooperating with, and structuring of, the wet fibrous web during manufacturing. In a particularly preferred embodiment the web contacting surface 20 comprises a plurality of spaced apart three-dimensional protuberances 22, 24, 26 distributed across the web-contacting surface 20 of the fabric 10 and together constituting from at least about 15 percent of the web-contacting surface, such as from about 15 to about 35 percent, more preferably from about 18 to about 30 percent, and still more preferably from about 20 to about 25 percent of the web-contacting surface.

The protuberances 22, 24, 26 may arranged to create a single visually connected element 50 and a plurality of elements 50*a*-50*d* may be arranged to form a pattern 52. The elements 50 are formed from at least two protuberances 22, 24 that have a long direction axis, i.e., the principal axis 30, extending in different directions such that the at least two protuberances 22, 24 merge, converge or diverge from one another. For example, with reference to element 50*c*, the element 50*c* comprises a first protuberance 22 having a principal axis 30*a* extending in a first direction and having an element angle $\alpha$1. The element 50*c* further comprises a second protuberance 24 having a principal axis 30*b* extending in a second direction and having an element angle $\alpha$2. The first and second protuberances 22, 24 merge at a convergence area 25 to form a third protuberance 26. The element angle ($\alpha$) may range from about −15 to 15 degrees, such as from about −10 to about 10 degrees, such as from about −5 to about 5 degrees. In one embodiment a first protuberance may have an element angle greater than about 0.5 degrees, and more preferably greater than about 2.0 degrees, such as from about 0.5 to about 15 degrees and more preferably from about 2.0 to about 10 degrees. A second protuberance may converge with the first protuberance and have an element angle from about −15 to −0.5 degrees, such as from about −2.0 to about −10 degrees.

The elements forming a pattern may extend generally in a first direction across one dimension of the fabric in a continuous fashion. In this manner a continuous element may provide the fabric with the appearance of a protuberance extending continuously from a first lateral edge of the fabric to a second lateral edge.

Generally the protuberances are spaced apart from one another so as to define a valley there-between. In certain instances, such as when the inventive papermaking fabrics are used as a through-air drying fabric, the fibers of the embryonic tissue web are deflected in the z-direction by the protuberances forming valley sidewalls and disposed along the valley bottom plane to yield a web having a three-dimensional topography. The spacing of protuberances can be provided such that the tissue web conforms to the protuberances and is deposited in the valley without tearing. The size, spacing and arrangement of the valleys may be optimized to provide the resulting tissue web with desired aesthetics or physical properties. Preferably the valleys are permeable to both liquid and air and facilitate the rapid transportation of both through the embryonic tissue web supported thereon as it is transported through the tissue making process.

With continued reference to FIG. 1, the web-contacting surface 20 may comprises a plurality of valleys 28, which are generally bounded by adjacent protuberances 22, 24 or 26 and coextensive with the upper surface plane of the fabric 10. The valleys 28 are generally permeable to liquids and allow water to be removed from the cellulosic tissue web by the application of differential fluid pressure, by evaporative mechanisms, or both when drying air passes through the embryonic tissue web while on the papermaking fabric 10 or a vacuum is applied through the fabric 10. Without being bound by any particularly theory, it is believed that the arrangement of protuberances and valleys allow the molding of the embryonic tissue web causing fibers to deflect in the z-direction and generate the caliper of, and patterns on the resulting tissue web.

Figure 2:
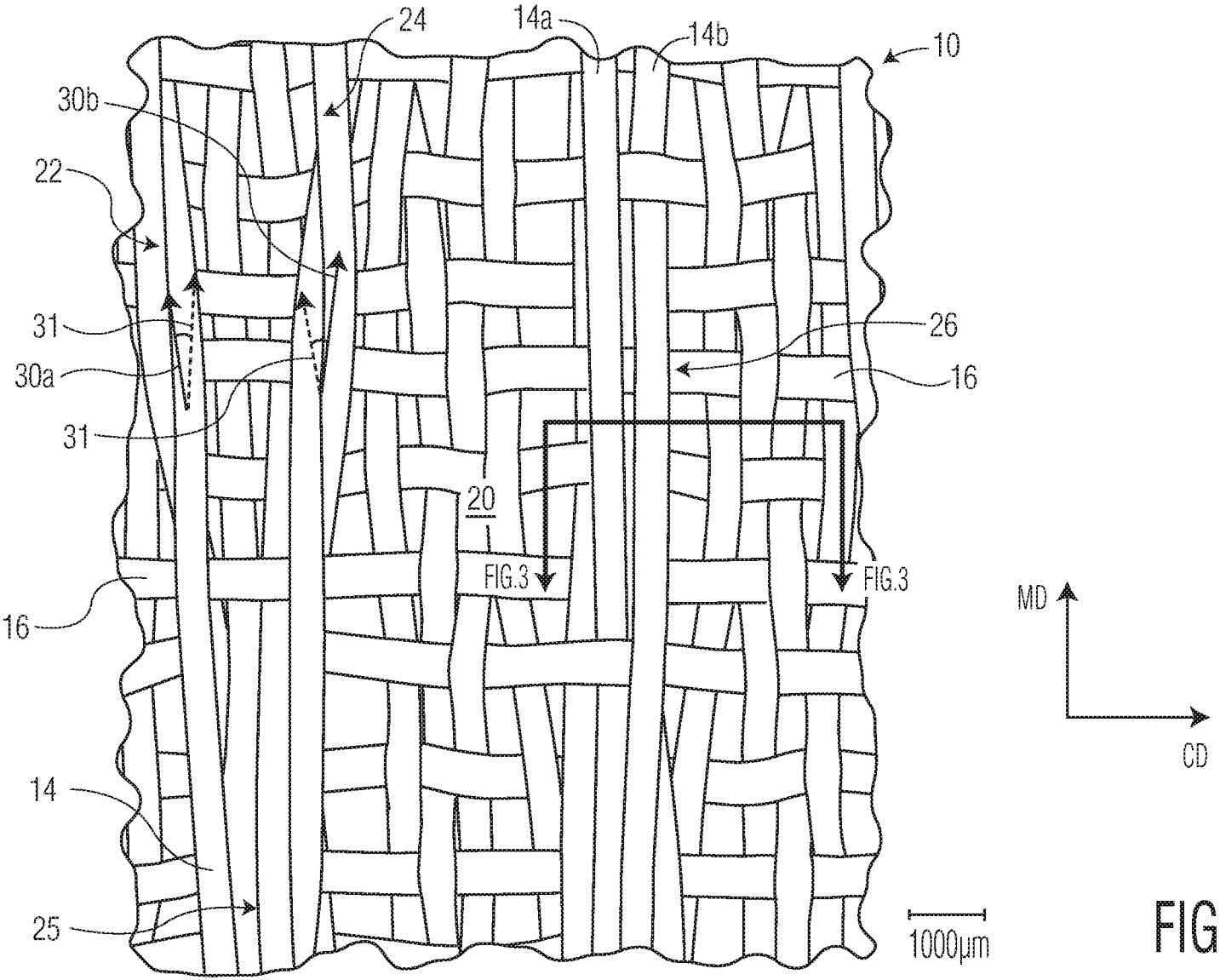
FIG. 2 is a top view of a woven papermaking fabric having a three-dimensional fabric contacting surface according to one embodiment of the present invention.
Figure 3:
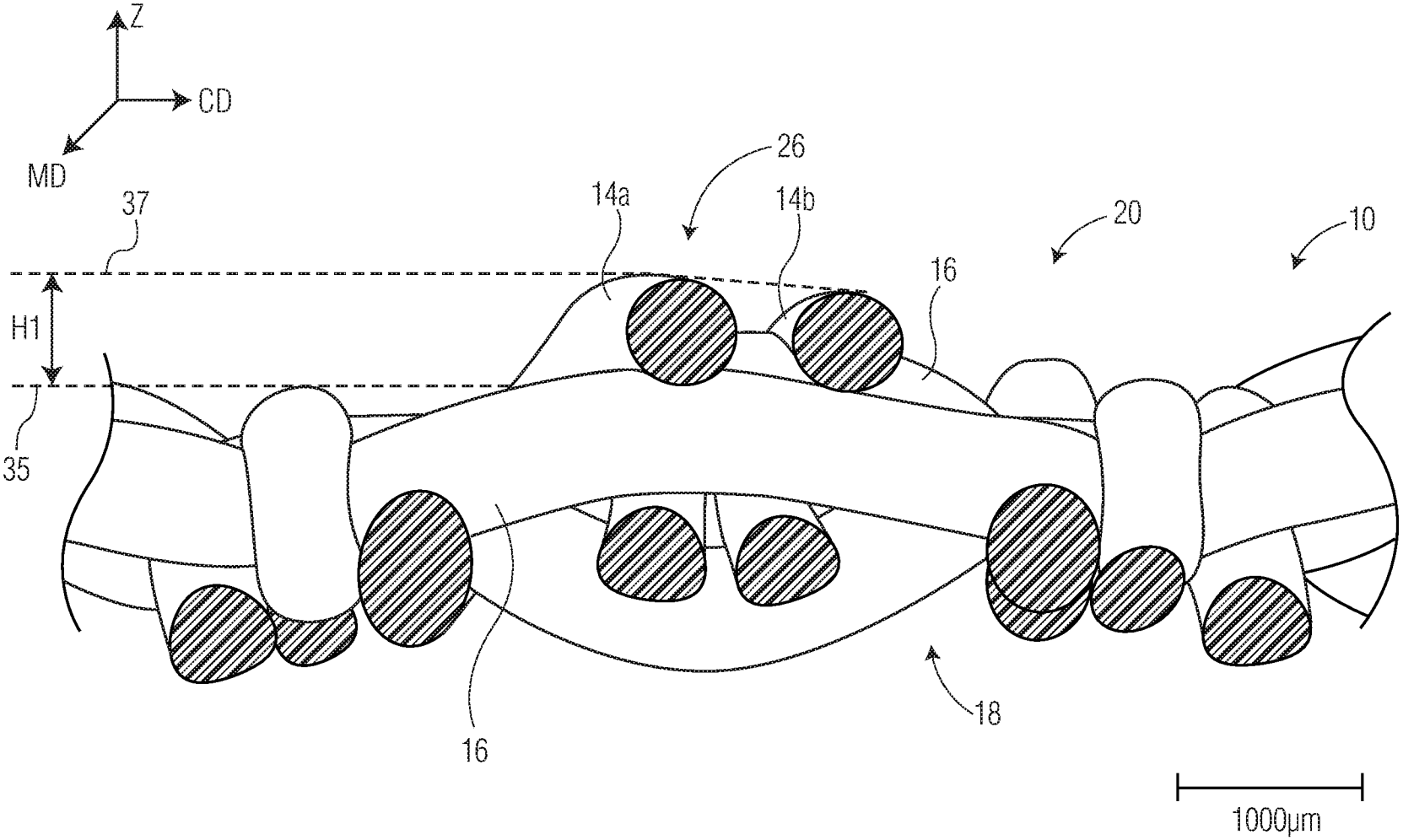
FIG. 3 is a cross-section view of the fabric of FIG. 2 through the line 3-3.
Figure 4:
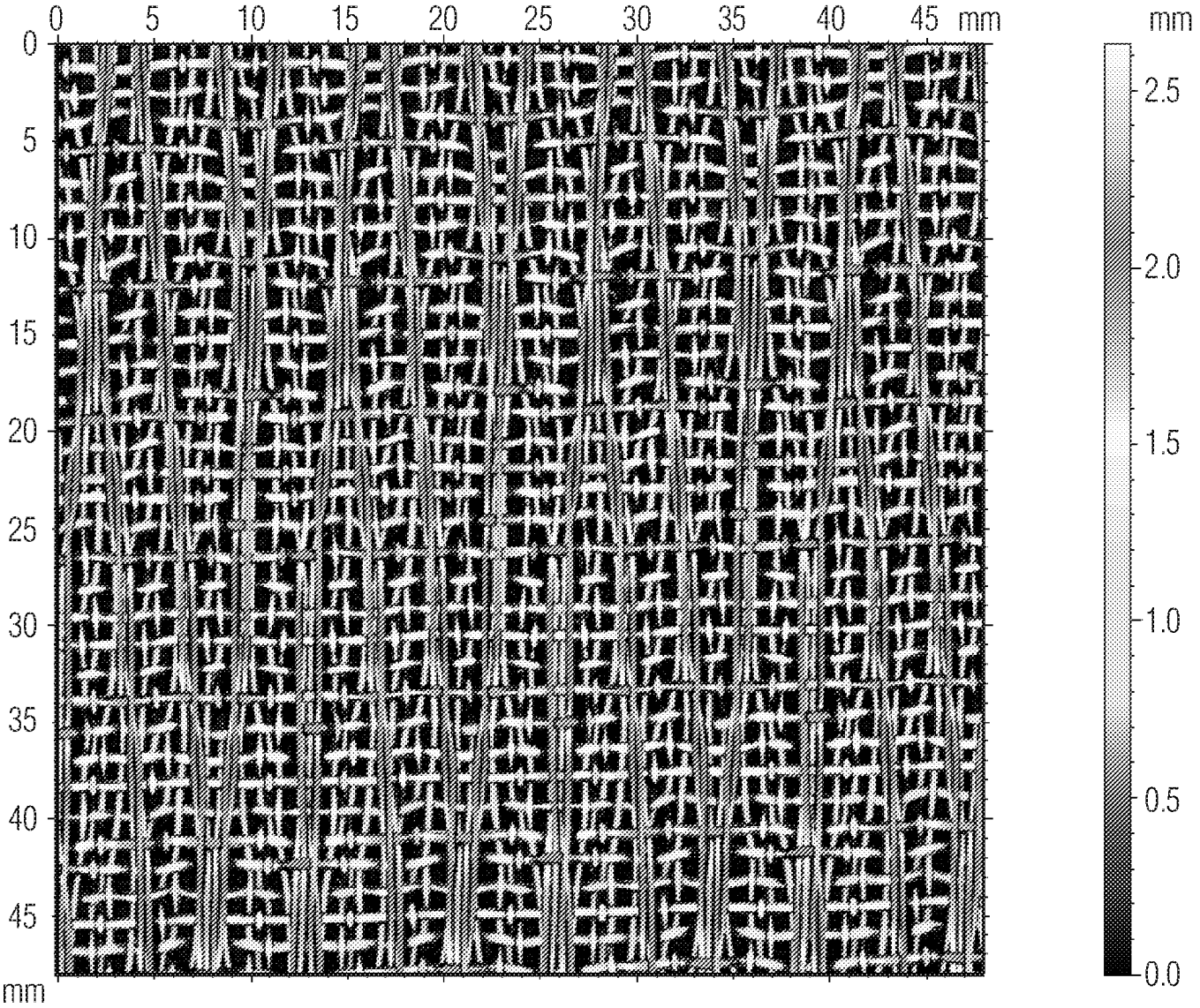
FIG. 4 is a profilometry scan of the fabric depicted in FIG. 2.

With reference to FIGS. 2 and 3, the MD oriented protuberance 22, 24, 26 may be formed from a pair of tightly woven warp filaments 14. The warp filaments 14 can vary in length, but typically rise over from about 5 to about 40, such as from about 10 to about 30 shute filaments 16, depending on the size and spacing of the weft yarns. The warp filaments forming a given protuberance overlap one another to a certain extent allowing the end of one warp float to tuck under the next machine direction oriented warp float. In this manner the protuberances may be formed from a pair of warps stacked on top of one another in a uniform fashion. As the warps tuck under one another they may increase the overall height of the protuberances and form a protuberance having a twisted rope appearance.

With reference now to FIG. 2, in the illustrated embodiment, the web contacting surface 20 comprises first and second MD oriented protuberances 22, 24 each of which are formed from a pair of warp filaments 14. The first MD oriented protuberance 22 has a principal axis 30*a* extending in a first direction and having an element angle α1. The second MD oriented protuberance 24 has a principal axis 30*b* extending in a second direction and having an element angle α2. The first and second protuberances 22, 24 merge at a convergence area 25 to form a third protuberance (not illustrated) which, like the first and second protuberances 22, 24 is substantially oriented in the machine direction.

With reference now to FIG. 3, the MD oriented protuberance 26, which is formed from warp filaments 14*a*, 14*b* woven above a shute filament 16, has an upper surface lying in an upper surface plane 37. Generally the portions of the warp filaments forming the protuberances are the highest points on the surface of the fabric and define the uppermost surface plane of the fabric. In this manner the MD oriented protuberance 26 extends in the z-direction (generally orthogonal to both the machine direction and cross-machine direction) above the valley surface plane 35. The z-direction difference between the valley surface plane 35 and the upper surface plane 37 generally defines the height (H1) of the MD oriented protuberance 26.

The cross-section shape of the MD oriented protuberances may vary depending on the size, shape and number of warp filaments that make-up the protuberance. For example, as illustrated in FIG. 3, the two warp filaments 14*a*, 14*b* are bundled together to form a protuberance 26 having a roughly planar upper surface and a pair of roughly parallel sidewalls. In this manner the protuberance 26 may be described as having an approximately rectilinear cross-sectional shape. While the illustrated protuberance has an approximately rectilinear cross-sectional shape, the invention is not so limited and one skilled in the art will appreciate that other cross-sectional shapes are possible, particularly when weaving fabrics from filaments having a circular cross-sectional shape.

The fabric illustrated in FIGS. 2 and 3 generally has protuberances having a height (H1) from about 0.5 to about 2.5 mm. The invention however, is not so limited and in certain embodiments the protuberance height (H1) may be varied depending on the desired degree of molding and the resulting tissue product properties. In certain embodiments the height (H1) may be greater than about 0.1 mm, such as from about 0.1 to about 10.00 mm, more preferably from about 0.25 to about 3.0 mm, and in a particularly preferred embodiment between from about 0.5 to about 2.5 mm. The height of the protuberance is generally uniform along its length, although slight height variances can be expected as a result of the protuberances being formed from woven filaments. Further, one skilled in the art will appreciate that the height of the protuberances may be altered my selecting warp filaments of different sizes and shapes and by the number of warps forming a given protuberance. Also, while the height of the protuberance is illustrated as being substantially uniform amongst the protuberances, the invention is not so limited and the protuberances may have different heights.

The foregoing protuberance heights generally result in fabrics having relatively deep valleys. As illustrated in FIG. 1, valleys 28 are generally bounded by adjacent protuberances 22, 24 or 26 and coextensive with the upper surface plane of the fabric 10. The adjacent protuberances form the valley sidewalls and may provide the valleys with a depth greater than about 0.30 mm, more preferably greater than about 0.35 mm and still more preferably greater than about 0.40 mms, such as from about 0.30 to about 1.0 mm. Further, in certain instances, the valley walls formed by adjacent protuberances may be relatively steep, such as wall angles greater than about 20 degrees and more preferably greater than about 22 degrees and still more preferably greater than about 24 degrees, such as from about 20 to about 45 degrees and more preferably from about 22 to about 40 degrees.

The protuberances may also be arranged so as to provide valleys of various width there between. Valley width is generally measured using profilometry as described herein and is reported as the Psm value, having units of mm. The valley width of a given fabric may vary depending on the weave pattern. For example, the width of the valley may be influenced by the spacing arrangement of the protuberances as well as the number of warp filaments used to form the protuberance. In certain instances the protuberances may be sized and arranged to provide valleys having a valley width greater than about 1.0 mm, more preferably greater than about 1.5 mm and still more preferably greater than about 2.0 mm, such as from about 1.5 to about 3.5 mm. Of course, it is contemplated that the width can be outside of the preferred range in some embodiments and still be within the scope of this disclosure.

In certain embodiments, it may be preferred that the upper surface plane of the protuberance extends uninterrupted for the length of the protuberance resulting in a protuberance having a height that is generally uniform along its length. For example, where a protuberance is continuous and extends throughout one dimension of the papermaking fabric its upper surface plane is preferably uninterrupted along the entire length to provide a single protuberance a substantially continuous height along its length. While it is generally desirable that the height of a protuberance be substantially constant along its length slight height variances can be expected as a result of the protuberances being formed from woven filaments. For example, it may be desirable that the height of a given protuberance vary less than ±150 μm and more preferably less than about ±100 μm along its length. To ensure that the height of a given protuberance is substantially constant along its length, it may be preferable to weave the protuberances from one or more warp filaments without inspecting or interrupting the one or more warp filaments with shute filaments.

The protuberance width may also vary depending on the construction of the fabric and its intended use. For example, the width of the protuberances may be influenced by the number of warp filaments used to form the protuberance, as well as the diameter of the filament used for a given warp float. In certain embodiments a protuberance may comprise from 2 to 8, such as 4 to 6, warp filaments. In other instances the warp filaments may have a diameter from about 0.2 to about 0.7 mm, such as from about 0.3 to about 0.5 mm and the protuberances may be woven from 2 to 6 adjacent warp filaments.

Protuberance width is generally measured normal to the principal dimension of the protuberance in a plane defined by the cross-machine direction (CD) at a given location. Where the protuberance has a generally square or rectangular cross-section, the width is generally measured as the distance between the two planar sidewalls that form the protuberance. In those cases where the protuberance does not have planar sidewalls the width is measured at the point that provides the greatest width for the configuration of the protuberance. For example, the width of a protuberance not having two planar sidewalls may be measured along the base of the protuberance. In some preferred embodiments, the width of the protuberances may have a width greater than about 0.5 mm, such as from about 0.5 to about 3.5 mm, more preferably from about 0.5 to about 2.5 mm, and in a particularly preferred embodiment between from about 0.7 to about 1.5 mm. In certain instances the protuberance may have a substantially square cross-sectional area such that the width and height are substantially equally, such as a height and a width from about 1.0 to about 2.0 mm. Of course, it is contemplated that the width can be outside of the preferred range in some embodiments and still be within the scope of this disclosure.

Further while in certain embodiments each of the plurality of protuberances may have similar height, width, length and wall angle, which are further arranged to provide the fabric with a single uniform pattern, the invention is not so limited. In other embodiments the papermaking fabric can include a plurality of protuberances that differ in at least one regard, such as height, width, length or wall angle.

Exemplary weave patterns and methods of manufacturing a woven papermaking fabric will now be described. In one embodiment, the papermaking fabric could be manufactured by providing a first set of filaments and a second set of filaments that are woven in a weave pattern. The first set of filaments can serve as warp filaments in a loom and the second set of filaments can serve as shute filaments in a loom. The method can additionally include weaving the shute filaments with the warp filaments in a lateral direction to provide a web contacting side of the woven papermaking fabric and a machine contacting side of the woven papermaking fabric and to provide a plurality of MD oriented protuberances and a plurality of substantially CD oriented protuberances on the web contacting side of the woven papermaking fabric. Weaving the shute filaments with the warp filaments can be accomplished by following weave patterns.

Figure 5:
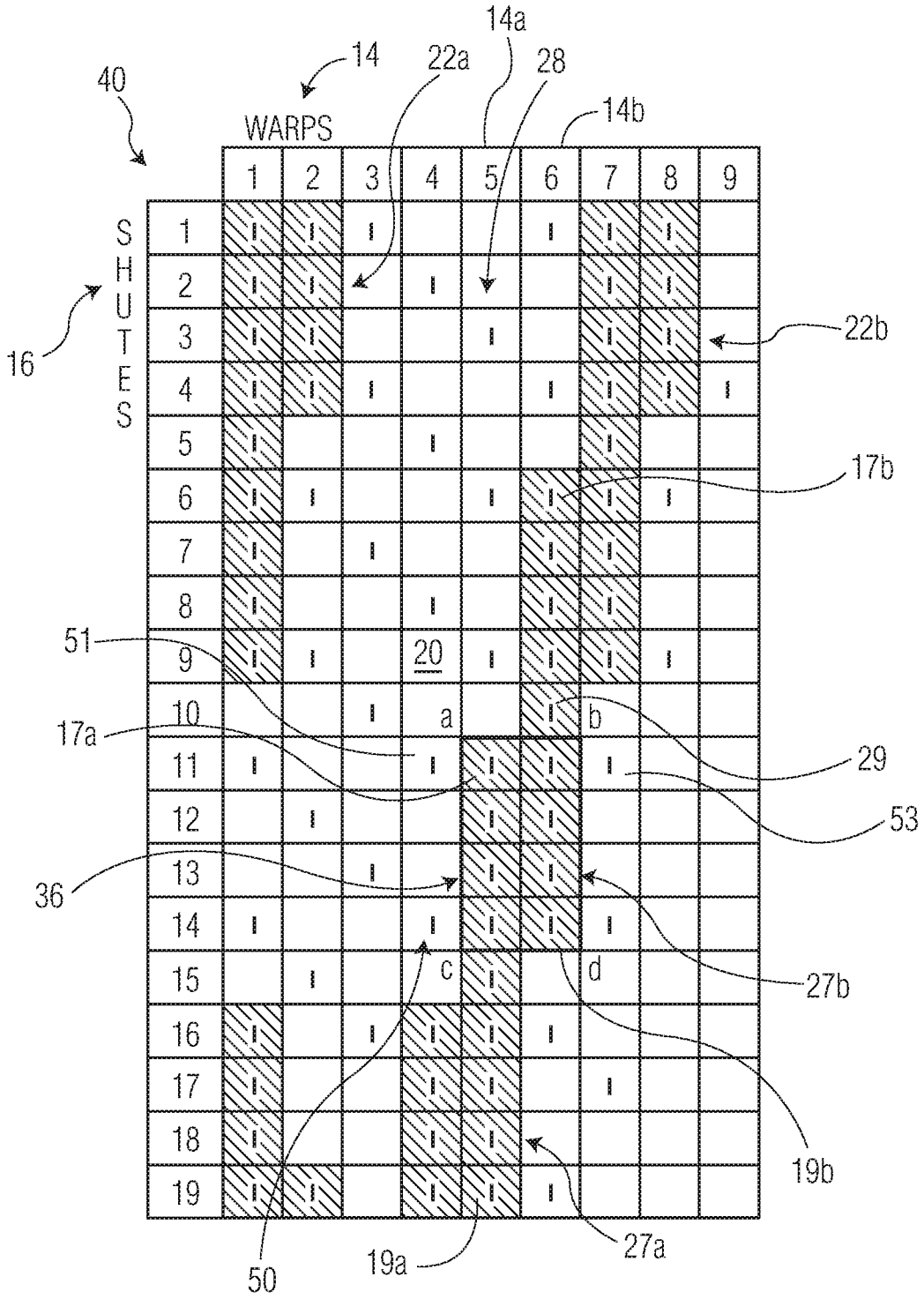
FIG. 5 illustrates a weave pattern useful in the manufacture of a woven papermaking fabric according to the present invention.

Various weave patterns can be used to guide the weaving of the shute filaments with the warp filaments and provide machine direction (MD) oriented protuberances that are stabilized on the papermaking fabric. One exemplary weave pattern 40 is shown in FIG. 5. The woven protuberances can be repeated as many times as desired in the machine direction and/or the cross-machine direction to form a desired pattern in a papermaking fabric. As an example, the woven protuberances may be repeated and arranged to create the weave pattern 40 illustrated in FIGS. 6A and 6B. The pattern 40 of FIGS. 6A and 6B, however, is just one way the woven protuberances may be combined and arranged to create a weave pattern for a papermaking fabric and the skilled artisan will be able to envision alternate means of arranging the protuberances to create a papermaking fabric having a pattern.

The weave pattern 40 of FIG. 5 will now be described in detail, however, the principles of weave pattern 40 may be adapted to form a broad range of unit cells that may be combined to form a twill pattern according to the present invention. The weave pattern 40 can include a plurality of warp filaments 14 generally aligned in the machine direction (MD) and a plurality of shute filaments 16 generally aligned in the cross-machine direction (CD). The weave pattern 40 can be configured on a loom (not pictured) such that the web contacting side 20 of the papermaking fabric will be facing out from the page, and the machine contacting side of the papermaking fabric will be facing into the page. Of course, it is contemplated that a weave pattern 40 could be configured in the opposite orientation on a loom. Each interchange of a specific warp filament 14 and a specific shute filament 16 of the weave pattern 40 that includes a vertical line segment (or a capital letter "I") provides a notation that the specific warp filament 14 is woven above the specific shute filament 16 at that interchange. For example, the interchange of warp filament No. 1 and shute filament No. 1 includes such a vertical line segment in FIG. 5, and thus, warp filament No. 1 is woven above shute filament No. 1. In some circumstances interchanges of warp filaments 14 and shute filaments 16 that have the vertical line segment (or capital letter "I") that will lead to the development of a protuberance 22 are also shaded with a cross-hatching pattern for purposes of clarity of perceiving the protuberances 22 of the weave pattern 40 provided herein. In other instances where a specific warp filament 14 lies between a specific shute filament 16 at a given interchange the pattern 40 is left blank.

The weave pattern 40 is configured with machine direction oriented warp filaments 14 woven with cross-machine oriented shute filaments 16 to form protuberances 22. Generally protuberances 22 are continuous areas in the weave pattern 40 in which a plurality of adjacent warp/shute filament interchanges are woven such that the warp filaments 14 are woven above their respective shute filaments 16. Protuberances 22 can be of various lengths and/or widths to provide various shapes. As shown in FIG. 5, the weave pattern 40 includes a first machine direction oriented protuberance 22*a* which forms a generally linear segment in shape and is spaced apart from a second similarly shaped protuberance 22*b*. Between the first and second protuberances 22*a*, 22*b* a valley 28 is formed. The illustrated valley 28 comprises warp/shute filament interchanges in which the warp filaments 14 are woven both above and below their respective shute filaments 16.

A pair of spaced apart machine direction oriented protuberance 22*a*, 22*b* each comprise protuberance forming warp portions 27*a*, 27*b* of a first 14*a* and a second 14*b* warp filament arranged in a pair-wise fashion. The pair-wise warp filaments 14*a*, 14*b* are adjacent warps (illustrated as warp positions Nos. 5 and 6) in the weave pattern 40. Each protuberance forming portion 27*a*, 27*b* of the warp filament 14*a*, 14*b* has a first proximal end 17 and first distal end 19 spaced apart in the machine direction (MD). Looking at a specific warp filament 14*a* within the weave pattern 40 in a top-to-bottom fashion, the float proximal end 17*a* can be the interchange of a specific shute filament and a specific warp filament that begins a series of adjacent interchanges in which the warp filaments are woven above that specific shute filament. The float distal end 19*a* can be the interchange of a specific shute filament and a specific warp filament that ends a series of adjacent interchanges in which the warp filaments are woven above that specific shute filament. In other words, a shute filament proximal end can be where the shute filament is woven from a web contacting side to the machine contacting side of the fabric and a shute filament float distal end can be where the shute filament is woven from a machine contacting side to the web contacting side of the fabric.

As further illustrated in FIG. 5, the weave pattern 40 is configured such that the pair of warp filaments 14*a*, 14*b* overlap one another along a portion of the protuberance 22*b*. The overlap portion, outlined by the box abcd and labeled as 36, is referred to herein as a "paired portion" and comprises a portion of the protuberance 22*a* where both the first and second filaments 14*a*, 14*b* are woven above the corresponding shute filament. In the illustrated embodiment the paired portion 36 has a float length of four (traversing shute position Nos. 11-14).

In addition to a paired portion 36, the protuberance 22 comprises a portion where adjacent warp filaments are not both woven above their corresponding shute filament. For example, with reference to protuberance 22*b*, warp filament 14*b* includes a single interchange (labeled as 29) where the protuberance 22*b* comprises a single warp filament woven above the corresponding shute filament.

The length of the protuberance forming portions of the warp filaments, that is the portion of a warp filament woven above the shute filaments to form a protuberance, may vary. For example, the warp shutes forming the protuberance may have a float length from four to twenty, such as from eight to sixteen and more preferably from ten to fourteen. Further, the vertical, or machine direction, distance between the proximal end of a first protuberance forming portion of a warp filament and the distal end of a second, adjacent, protuberance forming portion of a warp filament may vary in different embodiments. For example, in certain embodiments, float length between the proximal end 17*b* of protuberance forming portion 27*b* and the distal end 19*a* of directly adjacent protuberance forming portion 27*a* may be fourteen such as that shown in FIG. 5. In other embodiments, float length between the proximal end of a first warp filament and the distal end of a second directly adjacent, warp filament may be from twenty to sixty, such as from twenty-five to fifty.

While the number of shute filaments traversed by a given protuberance forming warp filament may vary, it is generally preferred that the protuberance be formed from two or more directly adjacent warp filaments and that the distal end of a first warp filament be offset from the proximal end of a second, adjacent, warp filament so as to form a paired portion. The paired portion preferably has a float length of at least two and more preferably at least three, and more preferably at least four, such as from two to twenty and more preferably from two to fourteen and still more preferably from four to ten.

With continued reference to FIG. 5 the weave pattern 40 further comprises banding 50 which may be used to further increase the z-directional displacement of the warp filaments 14 forming the protuberances 22. With specific reference to paired portion 36 of protuberance 22*b* formed from warps 14*a* and 14*b*, a pair of bands 50 are disposed at the first and second ends (when viewing the paired portion 36 in a top-to-bottom fashion). The bands 50 comprise a first directly adjacent (in the cross-machine direction) stitch 51 in which the interchange of warp and shute filaments comprises a warp filament above the shute float and second directly adjacent stitch 53 in which the interchange of warp and shute filaments comprises a warp filament above the shute float.

While certain inventive weave patterns, such as those illustrated in FIG. 5, incorporate banded protuberances, the invention is not so limited and in certain embodiments a protuberance may be woven without bands. In other embodiments, bands may be woven such that a paired portion comprises only a single band. In still other embodiments a paired portion may comprise two or more bands where at least one of the bands is disposed at the first end of the paired portion. The band may comprise a first directly adjacent (in the cross-machine direction) stitch in which the interchange of warp and shute filaments comprises a warp filament above the shute float and second directly adjacent stitch in which the interchange of warp and shute filaments comprises a warp filament below the shute float. In other embodiments the first and second directly adjacent stitches may both comprise a warp filament above the shute float.

Figure 6A:
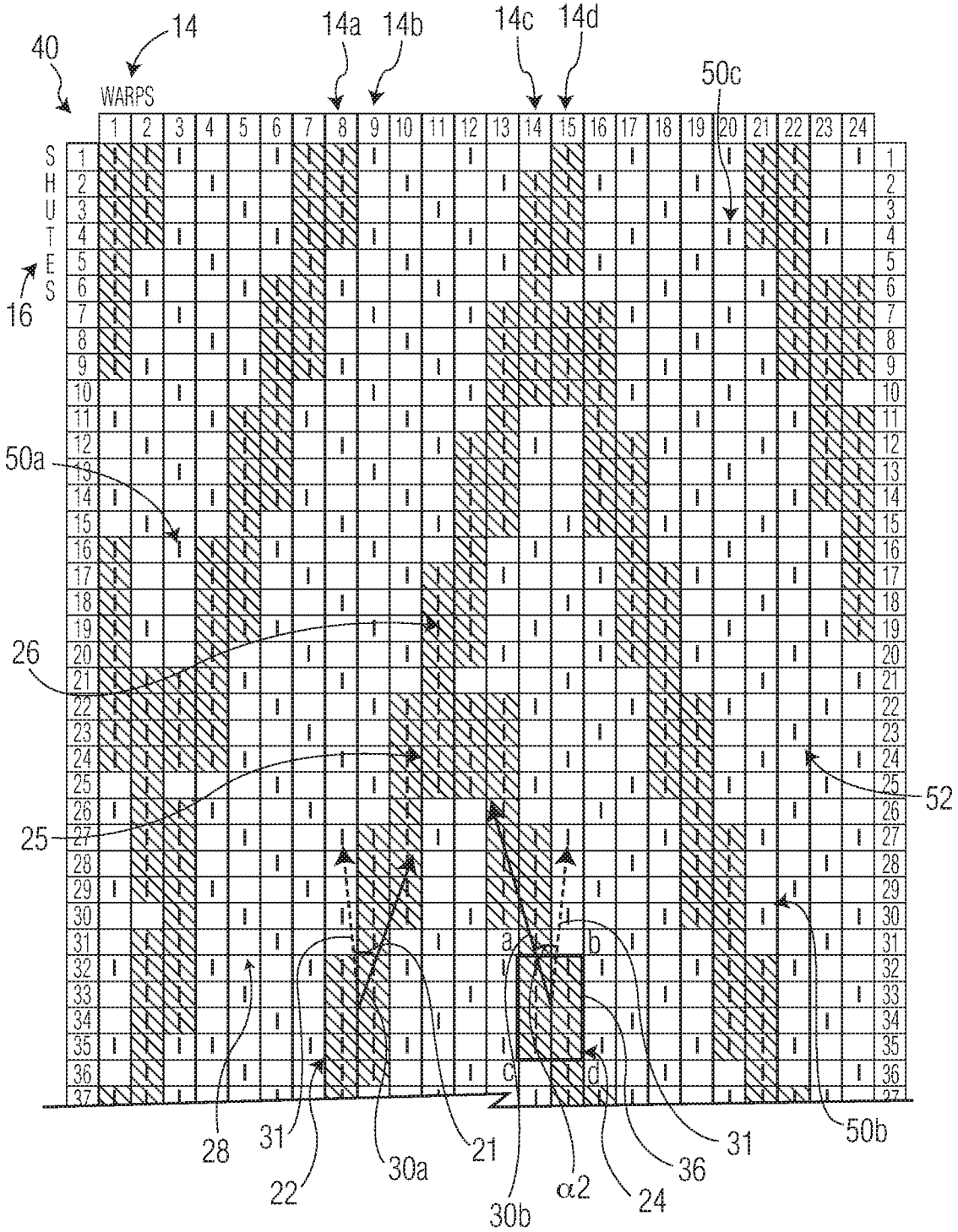
FIGS. 6A and 6B illustrate a weave pattern useful in the manufacture of a woven papermaking fabric according to the present invention.
Figure 6B:
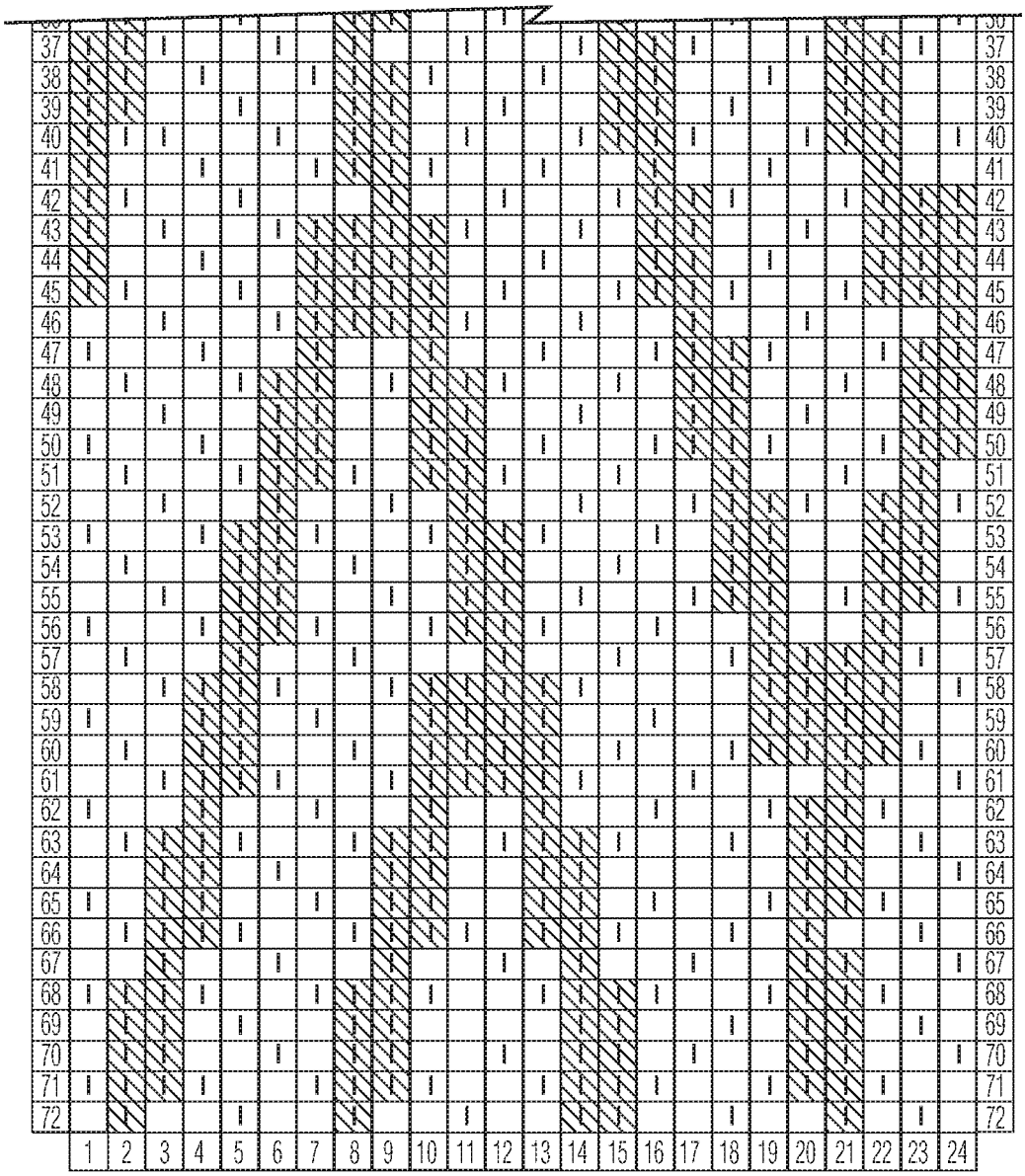
Figure 7:
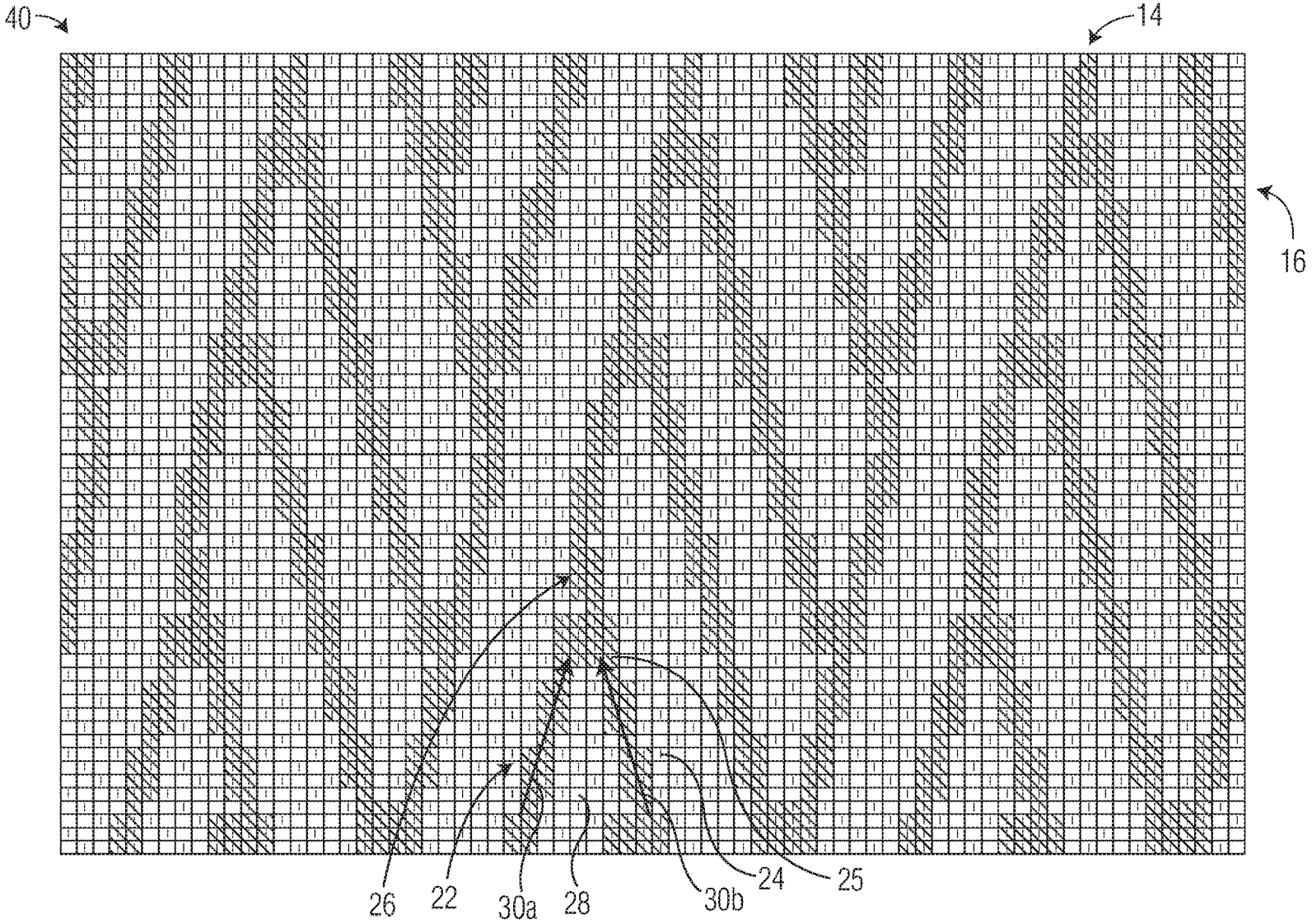
FIG. 7 illustrates another weave pattern useful in the manufacture of a woven papermaking fabric according to the present invention.

With reference now to FIGS. 6A and 6B the weave pattern 40 comprising a first machine direction (MD) oriented protuberance 22 having a first principal axis 30*a* oriented in a first direction and an element angle of about 8 degrees. The protuberance 22 comprises a pair of warp filaments 14*a*, 14*b* which overlap one another along a portion outlined by the box abcd and labeled as 36, is referred to herein as a "paired portion." Along the paired portion 36 both the first and second filaments 14*a*, 14*b* are woven above the corresponding shute filament to form a portion of the protuberance 22. In the illustrated embodiment the paired portion 36 has a float length of four (traversing shute position Nos. 32-35).

The weave pattern 40 further comprises a second machine direction (MD) oriented protuberance 24 having a second principal axis 30*b* oriented in a first direction and an element angle of about 8 degrees. The protuberance 24 comprises pair of warp filaments 14*c*, 14*d* that overlap one another to form a paired portion 36. The extent to which adjacent warp filaments forming a given protuberance overlap may vary, such as from two to ten shute filaments and more preferably from about three to eight shute filaments, allowing the end of one warp float to tuck under the next machine direction oriented warp float. In this manner the weave pattern yields protuberances comprising warp stacks with a degree of symmetry where warps are introduced and ended in uniform spacing.

The protuberances 22, 24 extend in different directions—the first protuberance 22 has a principal axis 30*a* extending in a first direction and having an element angle $\alpha 1$ and the second protuberance 24 has a principal axis 30*b* extending in a second direction and having an element angle $\alpha 2$. The first and second protuberances 22, 24 merge at a convergence area 25 to form a third protuberance 26. In this manner the first and second protuberances 22, 24 are arranged to create a single visually connected element 50*b* and a plurality of elements 50*a*-50*c* may be arranged to form a pattern 52.

The convergence area 26, illustrated in FIG. 6A comprises four warp filaments 14 woven above their corresponding shute filaments, a float length of four. In this manner the convergence area 25 has a width of four float lengths and a length of four float lengths. The first and second lateral ends of the convergence area 26 are formed from a portion of the warp filaments forming the first and second protuberances 22, 24 and a further portion of the convergence area 25 is formed from a portion of the warp filament forming the third protuberance 26. The convergence area 25 further comprises two pairs of bands 50, which comprise a stitch disposed at the first and second lateral ends of the warps forming the convergence area 25. The bands generally comprise a first directly adjacent (in the cross-machine direction) stitch in which the interchange of warp and shute filaments comprises a warp filament above the shute float and a second directly adjacent stitch in which the interchange of warp and shute filaments comprises a warp filament below the shute float. While the convergence is illustrated as comprising a pair of bands, the invention is not so limited, and the convergence area may comprise one or more bands, or in certain embodiments may not have any bands.

Figure 8:
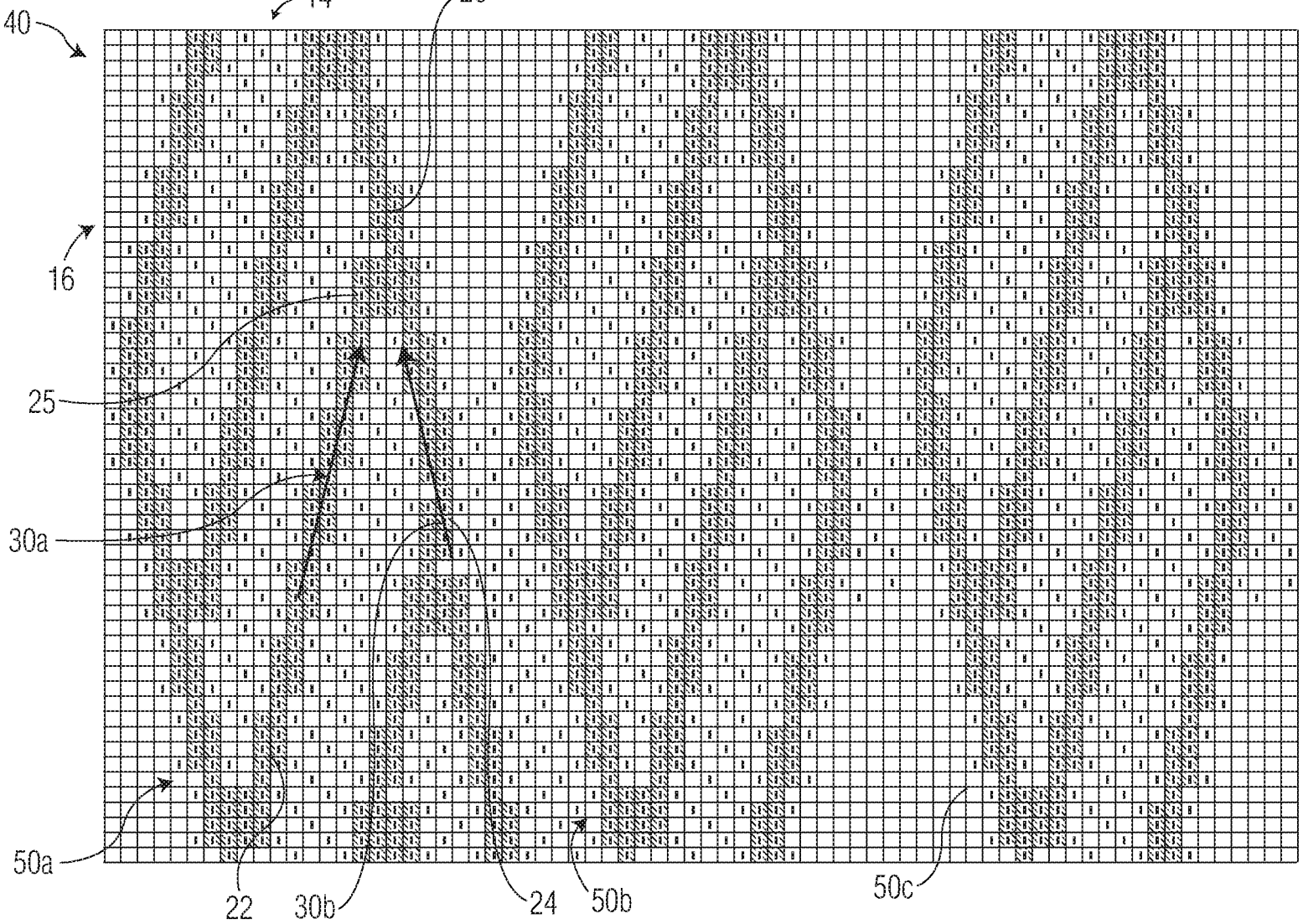
FIG. 8 illustrates still another weave pattern useful in the manufacture of a woven papermaking fabric according to the present invention.

With reference now to FIG. 8, another embodiment of a weave pattern 40 useful for forming a fabric having a plurality of elements 50*a*-50*d* combined to form a pattern 40 is illustrated. With reference to element 50*c*, the element comprises a plurality of protuberances that merge with one another. For example, the first and second protuberances 22, 24, which have principal axis 30*a*, 30*b* extending in different directions, merge at a convergence area 25 to form a third protuberance 26. The protuberances 22, 24, 26 are arranged so as to form an element 50*c* that forms part of the pattern 40. The three elements 50*a*-50*c* are similarly shaped and each comprise a plurality of protuberances 22, 24, 26 that merge with one another at convergence areas 25. Each of the convergence areas 25 have a similar weave pattern and consist of four directly adjacent warp floats woven above their corresponding shute filaments to yield a convergence area four float lengths wide and three float lengths long. Further the outer most lateral sides of the convergence area are formed from the first and second protuberances 22, 24 that merge to form the third protuberance 26.

Test Method

Valley Depth, Valley Width and Wall Angle

The valley depth and angle, as well as other fabric properties, are measured using a non-contact profilometer as described herein. To prevent any debris from affecting the measurements, all images are subjected to thresholding to remove the top and bottom 0.5 mm of the scan. To fill any holes resulting from the thresholding step and provide a continuous surface on which to perform measurements, non-measured points are filled. The image is also flattened by applying a rightness filter.

Profilometry scans of the fabric contacting surface of a sample were created using an FRT MicroSpy® Profile profilometer (FRT of America, LLC, San Jose, Calif.) and then analyzing the image using Nanovea® Ultra software version 7.4 (Nanovea Inc., Irvine, Calif.). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three-dimensional height map of the sample surface. A 1602×1602 array of height values were obtained with a 30 μm spacing resulting in a 48 mm MD×48 mm CD field of view having a vertical resolution 100 nm and a lateral resolution 6 um. The resulting height map was exported to .sdf (surface data file) format.

Individual sample .sdf files were analyzed using Nanovea® Ultra version 7.4 by performing the following functions:

(1) Using the "Thresholding" function of the Nanovea® Ultra software the raw image (also referred to as the field) is subjected to thresholding by setting the material ratio values at 0.5 to 99.5 percent such that thresholding truncates the measured heights to between the 0.5 percentile height and the 99.5 percentile height; and (2) Using the "Fill In Non-Measured Points" function of the Nanovea® Ultra software the non-measured points are filled by a smooth shape calculated from neighboring points.

(3) Using "Filtering>Wavyness+Roughness" function of the Nanovea® Ultra software the field is spatially low pass filtered (waviness) by applying a Robust Gaussian Filter with a cutoff wavelength of 0.095 mm and selecting "manage end effects";

(4) Using the "Filtering−Wavyness+Roughness" function of the Nanovea® Ultra software the field is spatially high pass filtered (roughness) using a Robust Gaussian Filter with a cutoff wavelength of 0.5 mm and selecting "manage end effects";

(6) Using the "Abbott-Firestone Curve" study function of the Nanovea® Ultra software an Abbott-Firestone Curve is generated from which "interactive mode" is selected and a histogram of the measured heights is generated, from the histogram an S90 value (95 percentile height (C2) minus the 5 percentile height (C1), expressed in units of mm) is calculated.

The foregoing yields three values indicative of the fabric topography—valley depth, valley width and wall angle. Valley width is the Psm value having units of millimeters (mm). Valley depth is the difference between C2 and C1 values, also referred to as S90, having units of millimeters (mm). Valley angle is the Pdq value having units of degrees (°).

Element Angle

Before measuring element angle, care must be taken to ensure that fabric is properly oriented before the surface map obtained by the FRT MicroSpy profilometer, as described above. To ensure that the warp filaments are aligned with the MD axis of the fabric and the wefts filaments aligned with the CD axis, a weft filament from the bottom of the fabric can be pulled by hand completely across the CD of the fabric to create a single weft filament aligned with the fabric CD axis. The single weft filament may then be used as a guide to align the fabric on the profilometer stage and a profilometer scan of the fabric may be obtained as described above.

Once a scan of the fabric is completed and the .sdf is analyzed as described above, the element angle is determined using the "texture direction" function under the "Studies" tab of the Nanovea® Ultra software. Once the "texture direction" is selected, the angle of the three most elevated features on the fabric surface will be reported. To calculate the element angle, the first value is selected and subtracted from 90. The resulting value is the element angle, having units of degrees.

Embodiments

In a first embodiment the present invention provides a woven papermaking fabric having a machine contacting side and an opposite web contacting surface, the web contacting surface comprising a first machine direction (MD) oriented protuberance having a first principal axis oriented in a first direction and an element angle from about 0.5 to about 15 degrees and a second MD oriented protuberance having a second principal axis oriented in a second direction and an element angle from about 0.5 to about 15 degrees, wherein the first and second MD oriented protuberances converge or merge at a convergence area to form a third MD oriented protuberance having a third principal axis oriented in a third direction and an element angle from about 0.5 to about 15 degrees, the MD oriented protuberances having a length, width and height, wherein the height is substantially constant along the length of the protuberance.

In a second embodiment the present invention provides the woven papermaking fabric of the first embodiment wherein the MD oriented protuberances have an element angle from 5.0 to 10.0 degrees.

In a third embodiment the present invention provides the woven papermaking fabric of the first or second embodiments wherein the MD oriented protuberances have a protuberance height from about 0.2 to about 5.0 mm.

In a fourth embodiment the present invention provides the woven papermaking fabric of any one of the first through third embodiments wherein the MD oriented protuberances comprise from 2 to 6 warp filaments.

In a fifth embodiment the present invention provides the woven papermaking fabric of the fourth embodiment wherein each warp filament forming the MD oriented protuberances is woven above its corresponding shute filament.

In a sixth embodiment the present invention provides the woven papermaking fabric of the fourth or fifth embodiments wherein each warp filament forming the MD oriented protuberances has a float length from 4 to 50 and the warp filaments have a paired portion having a float length from 2 to 8.

In a seventh embodiment the present invention provides the woven papermaking fabric of any one of the foregoing embodiments wherein the convergence area comprises at least four directly adjacent warp filaments woven above their corresponding shute filaments, wherein at least two of the directly adjacent warp filaments form a portion of the first and second protuberances and each of the directly adjacent warp filaments are woven above at least four shute filaments.

In an eighth embodiment the present invention provides the woven papermaking fabric of any one of the foregoing embodiments wherein the MD oriented protuberances have substantially similar height, width and length.

In a ninth embodiment the present invention provides the woven papermaking fabric of any one of the foregoing embodiments further comprising a discrete valley bounded by the first and second protuberances.

What is claimed is:

1. A woven papermaking fabric having a machine contacting side and an opposite web contacting surface, the web contacting surface comprising a plurality of machine direction (MD) oriented protuberances having a length, width and height, wherein a first MD oriented protuberance has a first principal axis oriented in a first direction and a second MD oriented protuberance has a second principal axis oriented in a second direction that is different than the orientation of the first principal axis, wherein the first and second MD oriented protuberances converge at a convergence area to form a third MD oriented protuberances having a third principal axis oriented in a third direction; wherein the first MD oriented protuberance has an element angle from 0.5 to 15.0 degrees, the second MD oriented protuberance has an element angle from −0.5 to −15.0 degrees and the third MD oriented protuberance has an element angle from 0.5 to 15.0 degrees.

2. The woven papermaking fabric of claim 1 wherein the first and second MD oriented protuberances define a valley there between and the first and second protuberances have a height from about 0.2 to about 5.0 mm.

3. The woven papermaking fabric of claim 1 wherein each of the plurality of MD oriented protuberances comprise from 2 to 6 warp filaments.

4. The woven papermaking fabric of claim 3 wherein each warp filament forming a MD oriented protuberance is woven above its corresponding shute filament.

5. The woven papermaking fabric of claim 4 wherein each warp filament forming a MD oriented protuberance has a float length from 4 to 50 and the warp filaments have a paired portion having a float length from 2 to 8.

6. The woven papermaking fabric of claim 1 wherein the convergence area comprises at least four directly adjacent warp filaments woven above their corresponding shute filaments, wherein at least two of the directly adjacent warp filaments form a portion of the first and the second protuberances and each of the at least two directly adjacent warp filaments are woven above at least four shute filaments.

7. The woven papermaking fabric of claim 1 wherein each of the plurality of MD oriented protuberances have substantially similar height, width and length.

8. The woven papermaking fabric of claim 1 further comprising a discrete valley bounded at least partially by the first and the second MD oriented protuberances.

9. The woven papermaking fabric of claim of claim 8 wherein the discrete valleys have a valley depth from about 0.30 to about 1.0 mm.

10. The woven papermaking fabric of claim 8 wherein the discrete valleys have a valley width from about 1.5 to about 3.5 mm.

11. The woven papermaking fabric of claim 1 wherein the plurality of MD oriented protuberances have a wall angle from about 22 to about 40 degrees.

12. The woven papermaking fabric of claim 1 wherein each of the plurality of MD oriented protuberances comprise a plurality of warp filaments woven in a twill pattern.

* * * * *